US007040224B2

(12) United States Patent
Eura

(10) Patent No.: US 7,040,224 B2
(45) Date of Patent: May 9, 2006

(54) ROLLER MOVING APPARATUS

(75) Inventor: Toshiharu Eura, Noda (JP)

(73) Assignee: Komori Corporation, Tokyo (JP)

( * ) Notice: Subject to any disclaimer, the term of this patent is extended or adjusted under 35 U.S.C. 154(b) by 77 days.

(21) Appl. No.: 10/901,126

(22) Filed: Jul. 29, 2004

(65) Prior Publication Data

US 2005/0022683 A1 Feb. 3, 2005

(30) Foreign Application Priority Data

Jul. 31, 2003 (JP) ..... 2003-204281

(51) Int. Cl.
*B41F 13/20* (2006.01)
*B41F 13/34* (2006.01)

(52) U.S. Cl. ..... 101/216; 101/479; 101/DIG. 35

(58) Field of Classification Search ..... 101/216, 101/479, 480, 212, 247, DIG. 35, 147, 148, 101/352.01, 352.04, 352.05; 414/911
See application file for complete search history.

(56) References Cited

U.S. PATENT DOCUMENTS 4,572,069 A * 2/1986 Schwarzbeck ..... 101/76
5,282,418 A 2/1994 Uera
5,632,202 A * 5/1997 Robesin et al. ..... 101/216

FOREIGN PATENT DOCUMENTS

EP 1092540 A1 4/2001
JP 2000-94648 A 4/2000

* cited by examiner

*Primary Examiner*—Leslie J. Evanisko
(74) *Attorney, Agent, or Firm*—Birch, Stewart, Kolasch & Birch, LLP

(57) ABSTRACT

A roller moving apparatus includes a pair of inner frames removably supported in a frame; a supportive holder member for supportively holding the roller; and a supportive holder member moving mechanism supported by the inner frames and adapted to support the supportive holder member and move the supportive holder member between a first position and a second position, the first position being either a position where the roller is attached to support members, or a position in the vicinity of the roller supported by the support members, and the second position being a position where the roller is supported on the inner frames. The inner frames have respective guide surfaces for guiding movement of the roller between the second position and a third position in the vicinity of an end surface of the frame.

14 Claims, 5 Drawing Sheets

ROLLER MOVING APPARATUS

CROSS REFERENCE TO RELATED APPLICATION

The entire disclosure of Japanese Patent Application No. 2003-204281 filed on Jul. 31, 2003 including specification, claims, drawings and summary is incorporated herein by reference in its entirety.

BACKGROUND OF THE INVENTION

1. Field of the Invention

The present invention relates to a roller moving apparatus for moving a roller, and more particularly to a roller moving apparatus that can be effectively applied to replacement of various rollers of a dampening unit and an inking unit of a printing press.

2. Description of the Related Art

In an inking unit or a dampening unit, for example, of a printing press, when an ink form roller or a dampening form roller, which is located furthest inward within a frame while being adjacent to a plate cylinder, is to be replaced, very troublesome work is involved in removing the roller from the inside of the frame and in placing a new roller at a predetermined position within the frame, since a number of other rollers and component members are present within the frame and located on the outer side of the ink form roller or the dampening form roller.

In order to cope with the above problem, Japanese Patent Application Laid-Open (kokai) No. 2000-94648, for example, proposes a roller support apparatus configured as follows. Arms are rotatably attached to corresponding shaft end portions of an ink oscillating roller. Distal ends of the arms are caused to support an ink form roller. Air cylinders are connected to corresponding proximal ends of the arms. When the ink form roller is to be replaced, the air cylinders are activated to thereby rotate the arms, whereby the ink form roller is moved to a position convenient for replacement.

The roller support apparatus described in the above patent publication is configured such that the ink form roller is moved by rotating the arms about the corresponding shaft end portions of the ink oscillating roller located adjacent to the ink form roller. Since the ink form roller cannot be moved to a great extent, very cumbersome work is involved in removing, from the arms, the ink form roller that has been moved to the replacement position, and in attaching a new ink form roller to bearings provided on the corresponding arms.

SUMMARY OF THE INVENTION

In order to solve the above problem, the present invention provides a roller moving apparatus comprising a pair of inner frames removably supported in a frame; a supportive holder member for supportively holding a roller; and a supportive holder member moving means supported by the inner frames and adapted to support the supportive holder member and move the supportive holder member between a first position and a second position, the first position being either a position where the roller is attached to a support member, or a position in the vicinity of the roller supported by the support member, and the second position being a position where the roller is supported on the inner frames. The inner frames have respective guide surfaces for guiding movement of the roller between the second position and a third position in the vicinity of an end surface of the frame.

Preferably, the supportive holder member is supported in such a manner as to be movable along an axial direction of the roller.

Preferably, the supportive holder member is curved at a radius of curvature substantially equal to that of an outer circumferential surface of the roller.

Preferably, the supportive holder member and supportive surfaces of the inner frames support the roller at the second position.

Preferably, the guide surfaces of the inner frames includes respective horizontal surfaces formed on a side toward the third position, and respective inclined surfaces formed on a side toward the second position.

Preferably, end portions of the inner frames located on the side toward the third position include respective stopper portions located higher than the horizontal surfaces.

Preferably, a distance between the paired inner frames disposed in such a manner as to face each other along an axial direction of the roller is shorter than a length of the roller in the axial direction.

Preferably, the guide surfaces of the inner frames guide a circumferential surface of the roller.

Preferably, the supportive holder member moving means includes a threaded shaft supported rotatably by the inner frames; threaded shaft rotating means for rotating the threaded shaft; a nut block screw-engaged with the threaded shaft; a movable member supported integrally by the nut block; and a slide plate adapted to support the supportive holder member and supported by the movable member in such a manner as to be slidable along an axial direction of the roller.

Preferably, the threaded shaft rotating means is located in the vicinity of the end surface of the frame.

Preferably, the threaded shaft is provided on each of the inner frames disposed in such a manner as to face each other along an axial direction of the roller, and the threaded shaft rotating means includes a pair of threaded shaft side bevel gears provided on corresponding proximal ends of the threaded shafts; a pair of intermediate bevel gears meshed with the corresponding threaded shaft side bevel gears; a driven shaft supported rotatably between the paired inner frames and adapted to coaxially support the intermediate bevel gears; a drive bevel gear meshed with one of the intermediate bevel gears; and a drive shaft connected coaxially to the drive bevel gear.

Preferably, the threaded shafts and the drive shaft of the threaded shaft rotating means are arranged such that an axial direction of the threaded shafts and an axial direction of the drive shaft intersect each other.

Preferably, the roller is a roller of a dampening unit or an inking unit of a printing press, and the inner frames are removably supported by an ink fountain of the inking unit.

Preferably, the inner frames have respective rest surfaces formed at distal ends and rest on a roller other than the roller to be moved, disposed within the printing press, through abutment of the rest surfaces on an outer circumferential surface of the roller.

The roller moving apparatus of the present invention can easily move a roller between a position in the vicinity of the frame of the printing press and a position where the roller is detached or attached, thereby facilitating replacement of the roller.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

With reference to FIGS. 1 to 6, an embodiment of the present invention will next be described in detail with regard to a roller moving apparatus applied to replacement of a dampening form roller of a dampening unit of a printing press.

Figure 1:
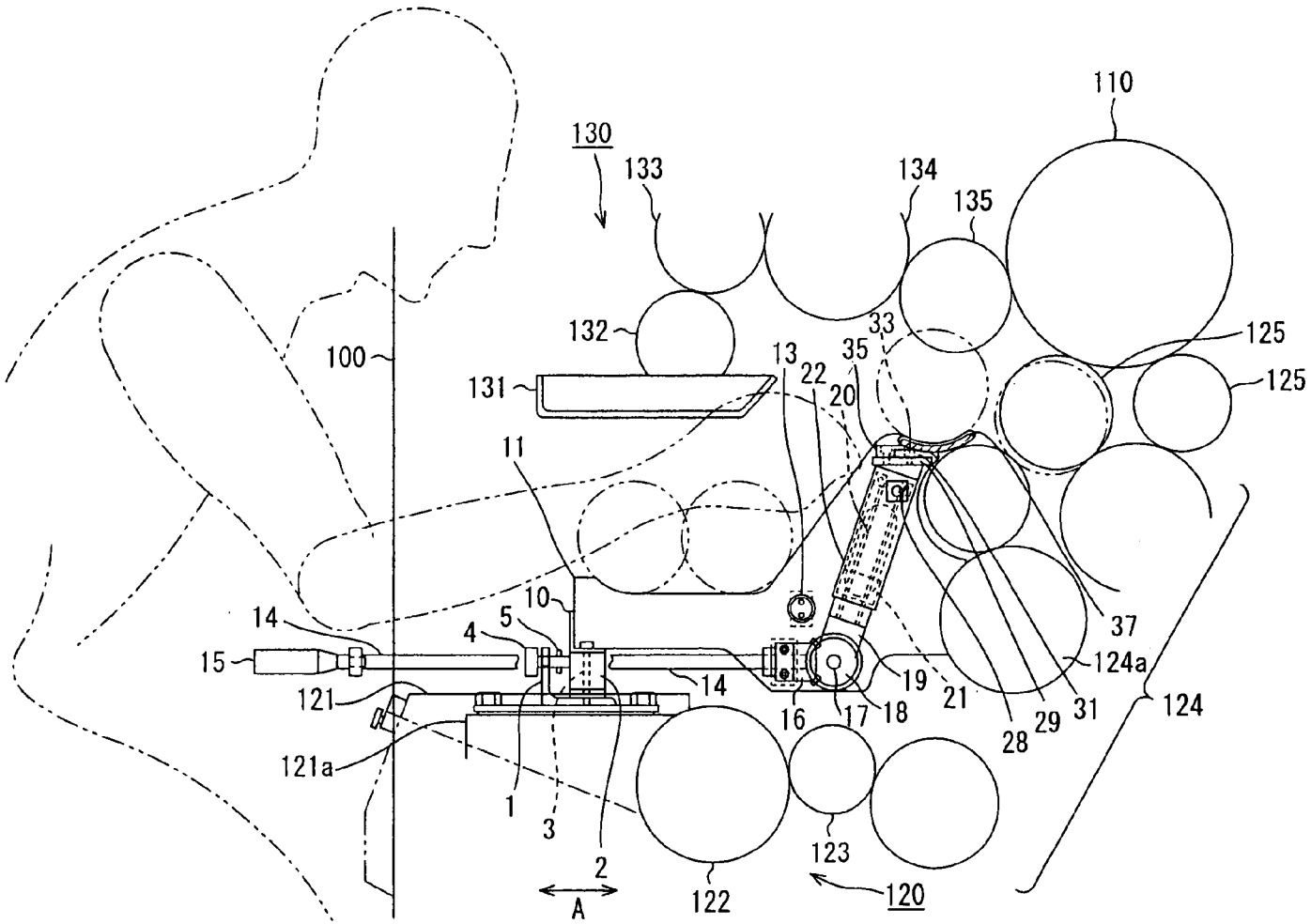
FIG. 1 is a side view of a roller moving apparatus according to an embodiment of the present invention, showing application to replacement of a dampening form roller of a dampening unit of a printing press.

In FIG. 1, reference numeral 100 denotes a frame of a printing press; reference numeral 110 denotes a plate cylinder; reference numeral 120 denotes an inking unit; and reference numeral 130 denotes a dampening unit.

As shown in FIG. 1, the inking unit 120 includes an ink fountain 121; an ink fountain roller 122; an ink ductor roller 123; an ink-roller group 124; and ink form rollers 125. The ink fountain roller 122 delivers ink from the ink fountain 121 to the ink ductor roller 123. The ink ductor roller 123 transfers the delivered ink to the ink-roller group 124. Then, the ink form rollers 125 supply the ink to the plate cylinder 110. These members 121 to 125 are supported by the frame 100 of the printing press.

As shown in FIG. 1, the dampening unit 130 includes a water fountain 131; a water fountain roller 132; a water transfer roller 133; an oscillating roller 134; and a dampening form roller 135. The water fountain roller 132 delivers water from the water fountain 131 to the water transfer roller 133. The water transfer roller 133 transfers the delivered water to the oscillating roller 134. Then, the dampening form roller 135 supplies the water to the plate cylinder 110. These members 131 to 135 are supported by the frame 100 of the printing press.

Figure 5:
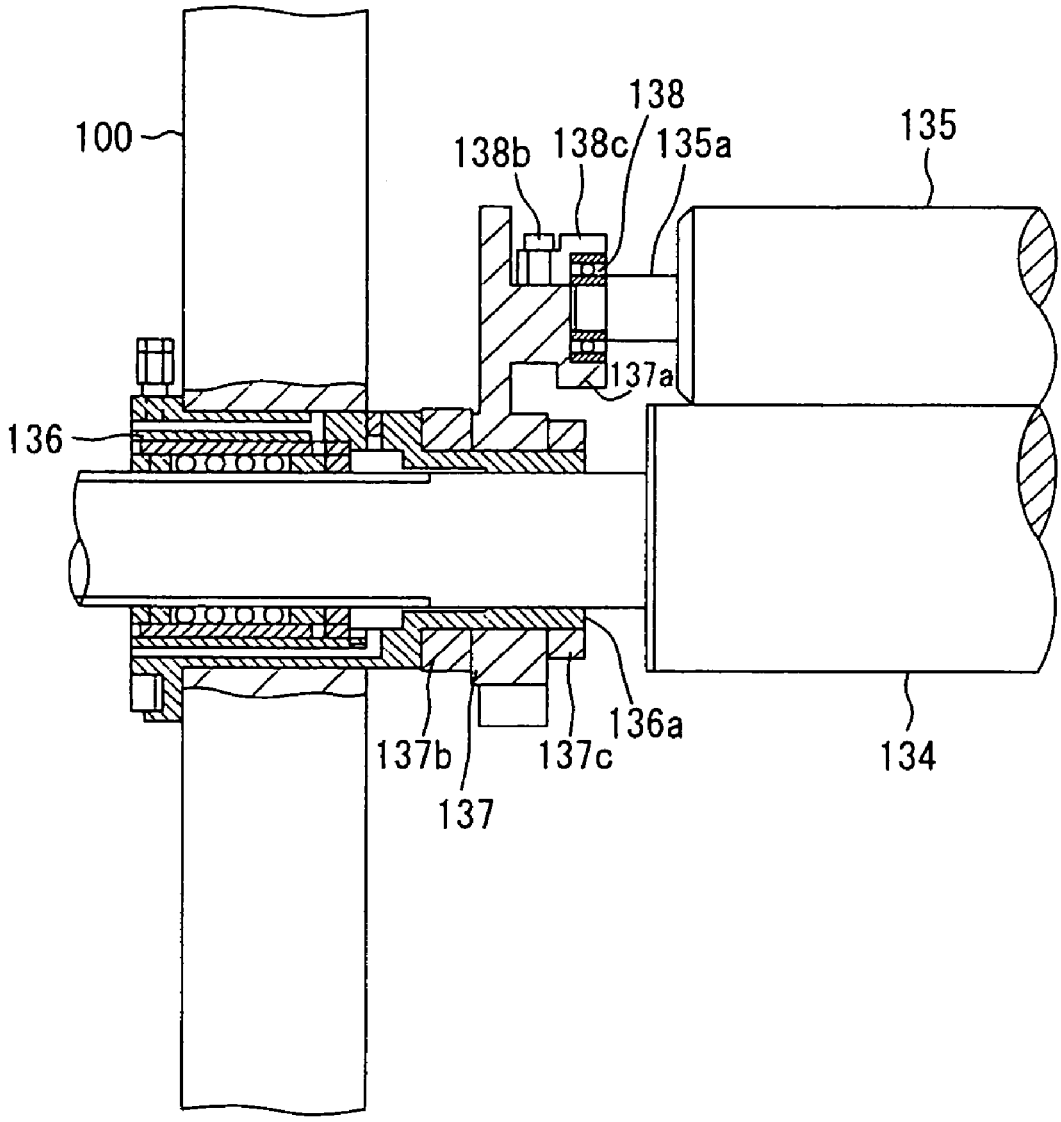
FIG. 5 is an explanatory view showing a support structure for an oscillating roller and the dampening form roller of the dampening unit.

As shown in FIG. 5, the oscillating roller 134 is supported by the frame 100 via two bearings 136 (FIG. 5 shows only one side, and herein description covers only one side) in such a manner as to be rotatable in the circumferential direction and movable in the axial direction. A proximal end portion of a lever 137 is supported on a small-diameter portion 136*a* of the bearing 136. The lever 137 serves as a support member, and its distal end portion is formed into a support portion 137*a*. The lever 137 is fixed on the bearing 136 by means of a sleeve 137*b* and a ring member 137*c*.

The support portion 137*a* of the lever 137 supports a bearing 138. An end shaft 135*a* of the dampening form roller 135 is rotatably supported by the bearing 138. A retainer piece 138*c* is fixed to the support portion 137*a* of the lever 137 with a bolt 138*b*, thereby preventing the bearing 138 from coming off the support portion 137*a*.

Figure 2:
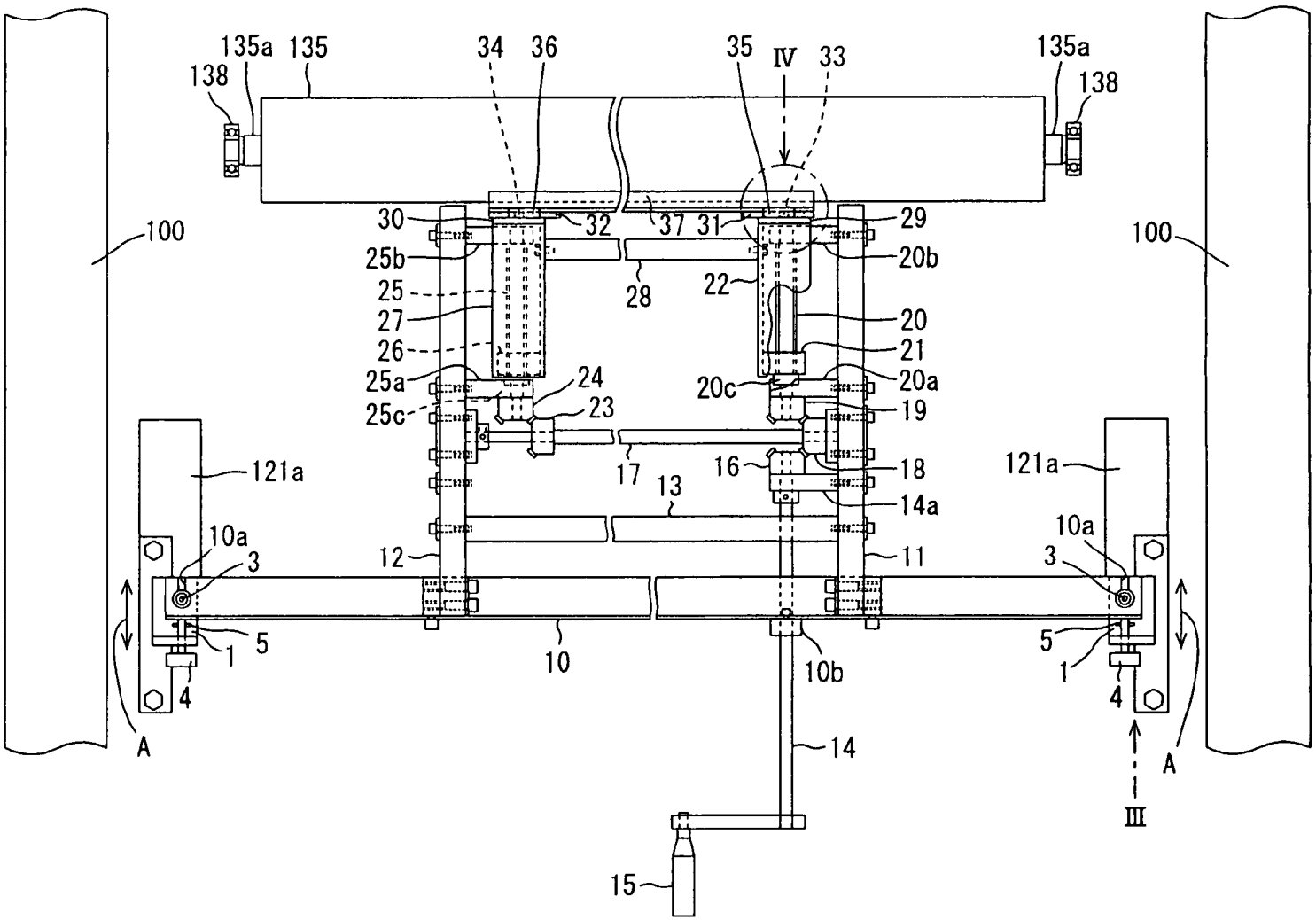
FIG. 2 is a plan view of the roller moving apparatus of FIG. 1.
Figure 3:
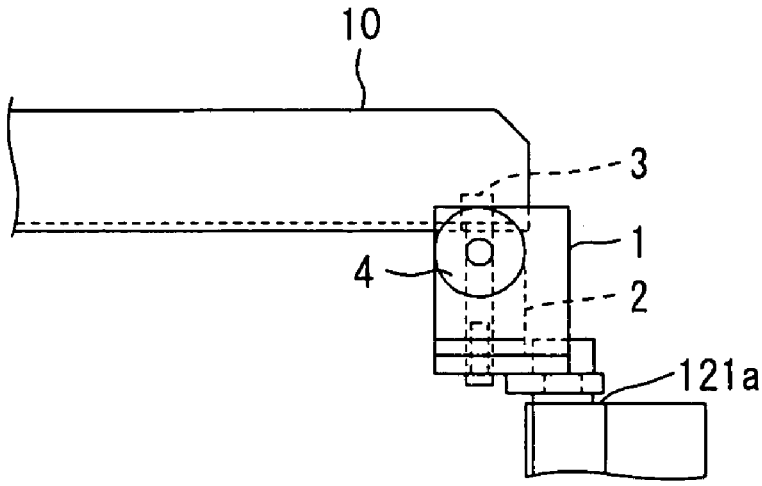
FIG. 3 is a view viewed in the direction of arrow III of FIG. 2.

As shown in FIGS. 1 to 3, metallic members 1 having an L-shaped cross section are fixed on corresponding upper end surfaces of widthwise opposite wall plates 121*a* of the ink fountain 121 of the inking unit 120. Support blocks 2 are disposed on the corresponding metallic members 1. A mounting bolt 3 is screw-engaged with each pair consisting of the metallic member 1 and the support block 2 to thereby fix the support block 2 on the metallic member 1, while leaving a gap between a head portion of the mounting bolt 3 and the support block 2 to allow a support stay 10, which will be described later, to move therebetween via its cutout 10*a*, in the direction of arrow A of FIGS. 1 and 2.

The support stay 10, which has an L-shaped cross section, is disposed on the widthwise opposite support blocks 2 in a bridging condition. The cutouts 10*a* are formed in the support stay 10 at opposite end portions to allow the support stay 10 to be removably fitted into the gaps formed between the head portions of the mounting bolts 3 and the support blocks 2. A press screw 4 is provided on each of the metallic members 1.

The support stay 10 is disposed on the widthwise opposite support blocks 2 in a bridging condition such that the cutouts 10*a* of the support stay 10 are fitted into the gaps formed between the head portions of the mounting bolts 3 and the support blocks 2. Subsequently, the press screws 4 are rotated. Tips of the press screws 4 abut the corresponding back surfaces of the support blocks 2 and press the support blocks 2, whereby the support stay 10 can be retained and positioned. In FIGS. 1 and 2, reference numeral 5 denotes retaining pins for preventing the corresponding press screws 4 from coming off the metallic members 1.

Figure 6:
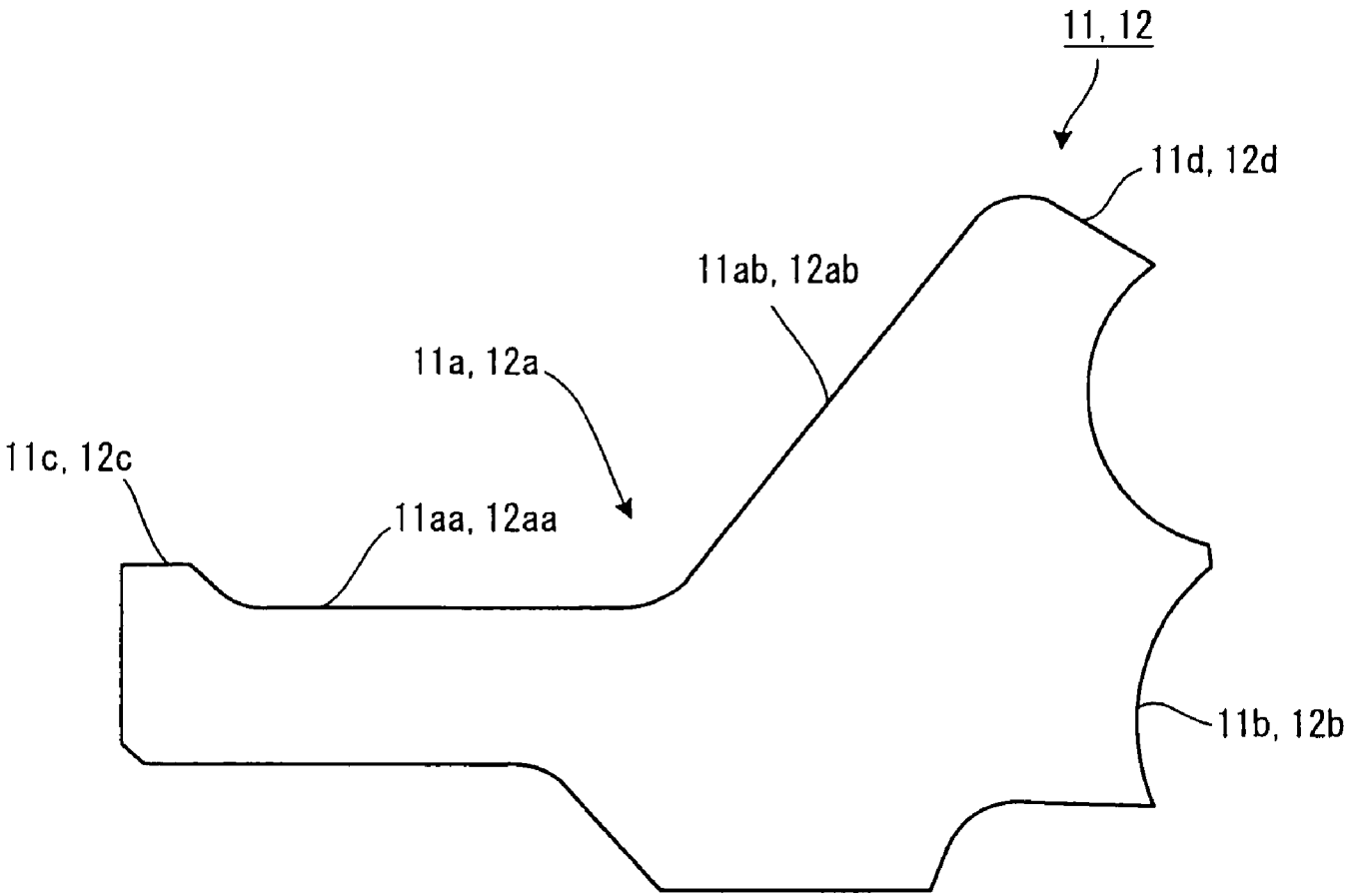
FIG. 6 is a schematic structural view of inner frames.

As shown in FIGS. 1 and 2, a pair of inner frames 11 and 12 is disposed in the frame 100 as follows: the distance between the inner frames 11 and 12 is shorter than the axial length of the dampening form roller 135; and proximal end portions of the inner frames 11 and 12 are fixedly supported on the support stay 10. As shown in FIG. 6, in the inner frame 11 (12), the upper surface is partially inclined such that its distal end portion is located higher than its proximal end portion to thereby become an upper end portion. Thus, the inner frames 11 and 12 can support the dampening form roller 135 such that the dampening form roller 135 can rotatively move on their upper surfaces between the proximal end side and the upper end side. Specifically, in the inner frame 11 (12), the upper surface includes a guide surface 11*a* (12*a*), which in turn includes a horizontal surface 11*aa* (12*aa*) formed on a side toward the proximal end (on a side toward a third position) and an inclined surface 11*ab* (12*ab*) formed on a side toward the upper end (on a side toward a second position). Also, the inner frame 11 (12) has a rest surface 11*b* (12*b*) formed at its distal end and having a radius of curvature substantially equal to that of the outer circumferential surface of a roller other than the dampening form roller 135 of the dampening unit 130; specifically, a roller in the ink-roller group 124 of the inking unit 120, and rests on the roller through abutment of the rest surface 11*b* (12*b*) on the outer circumferential surface of the roller. An end portion of the inner frame 11 (12) located on the side toward the proximal end (on the side toward the third position) includes a stopper portion 11*c* (12*c*) located higher than the horizontal surface 11*aa* (12*aa*). An upper end portion of the inner frame 11 (12) includes a supportive surface 11*d* (12*d*) adapted to support the dampening form roller 135 of the dampening unit 130.

In other words, the inner frames 11 and 12 are disposed in the frame 100 such that their proximal end portions are located in the vicinity of the end surface of the frame 100 (at the third position), and their upper end portions are located at a position (at the second position) in the vicinity of the dampening form roller 135 of the dampening unit 130 and at which a supportive holder plate 37 and the supportive surfaces 11*d* and 12*d* of the inner frames 11 and 12 support the dampening form roller 135. A support beam 13 extends between intermediate portions of the inner frames 11 and 12 to connect and support the inner frames 11 and 12.

A drive shaft 14 extends through the support stay 10 in such a manner that the longitudinal direction of the support stay 10 and the axial direction of the drive shaft 14 intersect each other perpendicularly. The drive shaft 14 is rotatably supported by the support stay 10 via a bearing member 10*b*. A handle lever 15 is attached to a proximal end portion of the drive shaft 14. A drive bevel gear 16 is coaxially fixed to the distal end of the drive shaft 14. A distal end portion of the drive shaft 14 is rotatably supported by the inner frame 11 via a bracket 14*a*.

The drive bevel gear 16 is meshed with an intermediate bevel gear 18. The intermediate bevel gear 18 is coaxially fixed to a first end portion of a driven shaft 17, which is rotatably supported between the inner frames 11 and 12. A threaded shaft side bevel gear 19 is meshed with the intermediate bevel gear 18. The threaded shaft side bevel gear 19 is coaxially fixed to the proximal end of a threaded shaft 20. The threaded shaft 20 is inclined such that its distal end is located higher than its proximal end, and is rotatably supported by brackets 20*a* and 20*b*, which in turn are supported by the inner frame 11. A thrust bearing 20*c* is provided between the threaded shaft 20 and the bracket 20*a*, which supports a proximal end portion of the threaded shaft 20. As described above, the drive shaft 14 and the threaded shaft 20 are arranged such that their axial directions intersect each other.

A nut block 21 is screw-engaged with the threaded shaft 20. A box-type movable member 22 is integrally attached to the nut block 21 in such a manner as to cover the threaded shaft 20 and the bracket 20*b*, which supports a distal end portion of the threaded shaft 20.

In operation, when the handle lever 15 is operated to rotate the drive bevel gear 16 via the drive shaft 14, the threaded shaft side bevel gear 19 is rotated via the intermediate bevel gear 18. Rotation of the threaded shaft side bevel gear 19 causes the threaded shaft 20 to rotate. As a result, the nut block 21 moves along the threaded shaft 20, whereby the movable member 22 can be moved upward/downward.

Meanwhile, an intermediate bevel gear 23 is coaxially fixed to the driven shaft 17 at a position biased toward a second end portion of the driven shaft 17. A threaded shaft side bevel gear 24 is meshed with the intermediate bevel gear 23. The threaded shaft side bevel gear 24 is coaxially fixed to the proximal end of a threaded shaft 25. The threaded shaft 25 is inclined such that its distal end is located higher than its proximal end, and is rotatably supported by brackets 25*a* and 25*b*, which in turn are supported by the inner frame 12. A thrust bearing 25*c* is provided between the threaded shaft 25 and the bracket 25*a*, which supports a proximal end portion of the threaded shaft 25. As described above, the drive shaft 14 and the threaded shaft 25 are arranged such that their axial directions intersect each other.

A nut block 26 is screw-engaged with the threaded shaft 25. A box-type movable member 27 is integrally attached to the nut block 26 in such a manner as to cover the threaded shaft 25 and the bracket 25*b*, which supports a distal end portion of the threaded shaft 25. A support beam 28 extends between the movable members 22 and 27 to connect and support the movable members 22 and 27.

In operation, when the handle lever 15 is operated to rotate the drive bevel gear 16 via the drive shaft 14, as described above, the threaded shaft side bevel gear 19 is rotated via the intermediate bevel gear 18. Also, the intermediate bevel gear 23 is rotated via the driven shaft 17, and the threaded shaft side bevel gear 24 is rotated via the intermediate bevel gear 23. Rotation of the threaded shaft side bevel gear 24 causes the threaded shaft 25 to rotate. As a result, the nut block 26 moves along the threaded shaft 25, whereby the movable member 27 can be moved upward/downward. Thus, the movable members 22 and 27 can be synchronously and unitarily moved upward/downward.

Figure 4:
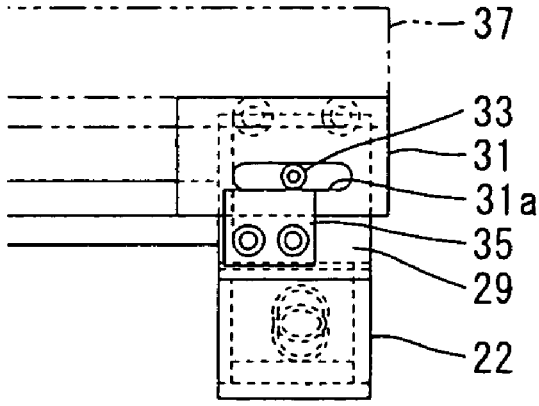
FIG. 4 is an enlarged view of a portion indicated by arrow IV of FIG. 2.

As shown in FIGS. 1, 2, and 4, attachment plates 29 and 30 are attached to respective distal ends of the movable members 22 and 27, respectively. Slide plates 31 and 32 are disposed on the attachment plates 29 and 30, respectively. A guide groove 31*a* is formed in the slide plate 31 such that the longitudinal direction of the guide groove 31*a* is in parallel with the axial direction of the dampening form roller 135 of the dampening unit 130. A guide groove similar to the guide groove 31*a* is similarly formed in the slide plate 32.

A guide pin 33 is provided on the attachment plate 29 in a standing condition and is engaged with the guide groove 31*a* of the slide plate 31 in a mutually slidable condition. Similarly, a guide pin 34 is provided on the attachment plate 30 in a standing condition and is engaged with the guide groove of the slide plate 32 in a mutually slidable condition. In order to prevent the slide plates 31 and 32 from coming off the guide pins 33 and 34, respectively, guide plates 35 and 36 are attached to the attachment plates 29 and 30, respectively.

The supportive holder plate 37, which serves as a supportive holder member, is mounted on the slide plates 31 and 32 in a bridging condition. The supportive holder plate 37 is curved at a radius of curvature substantially equal to that of the dampening form roller 135 of the dampening unit 130.

Thus, the slide plates 31 and 32 can be slid along the axial direction of the dampening form roller 135 while supporting the supportive holder plate 37.

In the present embodiment, the metallic members 1, the support blocks 2, the mounting bolts 3, the press screws 4, the retaining pins 5, among others, constitute positioning-fixing means; the drive shaft 14, the handle lever 15, the bevel gears 16, 18, 19, 23, and 24, the driven shaft 17, among others, constitute threaded shaft rotating means located in the vicinity of an end surface of the frame 100; and the threaded shaft rotating means, the threaded shafts 20 and 25, the nut blocks 21 and 26, the movable members 22 and 27, the support beam 28, the attachment plates 29 and 30, the slide plates 31 and 32, the guide pins 33 and 34, the guide plates 35 and 36, among others, constitute supportive holder member moving means.

Next will be described replacement of the dampening form roller 135 of the dampening unit 130 of the printing press by use of the thus-configured roller moving apparatus according to the present embodiment.

First, the support stay 10 is placed, in a bridging condition, on the support blocks 2 mounted on the ink fountain 121 of the inking unit 120 within the frame 100 of the printing press. The cutouts 10*a* of the support stay 10 are fitted into the corresponding gaps formed between the head portions of the mounting bolts 3 and the support blocks 2. Subsequently, the press screws 4 are rotated to thereby press the support blocks 2 forward, to cause the inner frames 11 and 12 rest on a roller 124*a* in the ink-roller group 124 of the inking unit 120 through abutment of the rest surfaces 11*b* and 12*b*, which are formed on the corresponding distal ends of the inner frames 11 and 12, on the outer circumferential surface of the roller 124*a*. In this manner, the support stay 10 and the inner frames 11 and 12 are supported and positioned. Then, the bolts 3 are fastened.

Subsequently, the handle lever 15 is operated to rotate the drive shaft 14, thereby rotating the threaded shafts 20 and 25 via the bevel gears 16, 18, and 19, the driven shaft 17, and the bevel gears 23 and 24. Through rotation of the threaded shafts 20 and 25, the supportive holder plate 37 is raised via the nut blocks 21 and 26, the movable members 22 and 27, among others, to a position (first position) in the vicinity of the dampening form roller 135 of the dampening unit 130, the dampening from roller 135 being supported by the support portions 137*a* of the levers 137. Thus, the supportive holder plate 37 is brought into contact with a lower portion of the outer circumferential surface of the dampening form roller 135.

Then, the bolts 138*b* of the dampening unit 130 are removed to thereby remove the retainer pieces 138*c*. The dampening form roller 135, together with the bearings 138, is removed from the support portions 137*a* of the levers 137, whereby the dampening from roller 135 is supported and held on the supportive holder plate 37.

Next, the handle lever 15 is operated to rotate the drive shaft 14 in the reverse direction of the above-described operation, thereby lowering the supportive holder plate 37 to a position (second position) corresponding to the upper ends of the inner frames 11 and 12. At the second position, the supportive holder plate 37 and the supportive surfaces lid and 12*d* of the inner frames 11 and 12, respectively, support and hold the dampening form roller 135. Subsequently, the dampening form roller 135 is caused to roll toward the operator off the supportive holder plate 37 and the supportive surfaces 11*d* and 12*d*. The dampening form roller 135 rolls on the inclined surfaces 11*ab* and 12*ab* and the horizontal surfaces 11*aa* and 12*aa*, which constitute the guide surfaces 11*a* and 12*a* of the inner frames 11 and 12. In this manner, the dampening form roller 135 moves by rolling from the upper-end portions of the inner frames 11 and 12 to the proximal-end portions of the inner frames 11 and 12 and reaches a position (third position) in the vicinity of the end surface of the frame 100 of the printing press.

Since the distance between the facing inner frames 11 and 12 is shorter than the axial length of the dampening form roller 135, even when the dampening form roller 135 slides axially at the time of its detachment, the dampening form roller 135 does not come off the inner frames 11 and 12 during the course of rolling on the inner frames 11 and 12.

As described above, the dampening form roller 135 can be readily taken out to the exterior of the frame 100 of the printing press.

By contrast, when a new dampening form roller 135 is to be mounted, the new dampening form roller 135 is placed on the proximal-end portions of the inner frames 11 and 12 (at the third position). The dampening form roller 135 is moved by rolling on the horizontal surfaces 11*aa* and 12*aa* and the inclined surfaces 11*ab* and 12*ab*, which constitute the guide surfaces 11*a* and 12*a*, to the upper-end portions of the inner frames 11 and 12; i.e., to a position (second position) that is located in the vicinity of a dampening-form-roller attachment position and where the dampening form roller 135 is supported and held. At the second position, the dampening form roller 135 is placed on the supportive holder plate 37 and on the supportive surfaces 11*d* and 12*d* of the inner frames 11 and 12, respectively.

Next, the handle lever 15 is operated to rotate the drive shaft 14 in such a manner as to raise the supportive holder plate 37 to a position (first position) where the dampening form roller 135 of the dampening unit 130 is attached to the support portions 137*a* of the levers 137. Subsequently, bosses 138*a* of the corresponding bearings 138 attached to the corresponding end shafts 135*a* of the dampening form roller 135 are fitted to the corresponding support portions 137*a* of the levers 137. The retainer pieces 138*c* are fixed by use of the bolts 138*b*, thereby supporting the dampening form roller 135 by the support portions 137*a* of the levers 137.

Meanwhile, even when, at the time of placing the dampening form roller 135 on the proximal-end portions of the inner frames 11 and 12, the axial position of the dampening form roller 135 deviates from an axial attachment position at which the dampening form roller 135 is attached to the frame 100 of the printing press, no problem arises. Specifically, since the supportive holder plate 37 can be slid in relation to the inner frames 11 and 12 along the axial direction of the dampening form roller 135 by means of the slide plates 31 and 32 and the like, the supportive holder plate 37 that carries the dampening form roller 135 can be slid as needed, whereby the axial position of the dampening form roller 135 can be readily corrected to a predetermined axial attachment position at which the dampening form roller 135 is attached to the frame 100 of the printing press. Thus, the dampening form roller 135 can be attached accurately and readily to the frame 100 at the predetermined axial attachment position via the levers 137.

After the dampening form roller 135 is attached to the levers 137 as described above, the handle lever 15 is operated to lower the supportive holder plate 37. Subsequently, the press screws 4 are loosened, and the support stay 10 is released from clamp between head portions of the mounting bolts 3 and the corresponding support blocks 2. Then, the support stay 10 is removed from inside the frame 100 of the printing press.

Thus, the roller moving apparatus according to the present embodiment can easily move the dampening form roller 135 between a position in the vicinity of an end of the frame 100 of the printing press and a position where the dampening form roller 135 is detached or attached, thereby facilitating replacement of the dampening form roller 135.

Since there is no need to fixedly provide bulky members, such as air cylinders and arms, within the frame 100 of the printing press, the detached dampening form roller 135 can be readily removed from inside the frame 100, and a new dampening form roller 135 can be readily brought to a predetermined position within the frame 100, without involvement of structural complication within the frame 100 of the printing press.

Since the threaded shaft rotating means, such as the handle lever 15, is located in the vicinity of the end surface of the frame 100, convenience of operation can be enhanced.

Since the distance between the facing inner frames 11 and 12 is shorter than the axial length of the dampening form roller 135, even when the dampening form roller 135 slides axially at the time of its detachment, the dampening form roller 135 can be prevented from coming off the inner frames 11 and 12 during the course of rolling on the inner frames 11 and 12, thereby enhancing work safety and facilitating work.

Since the upper surface of the inner frame 11 (12) includes the guide surface 11*a* (12*a*), which in turn includes the horizontal surface 11*aa* (12*aa*) formed on the side toward the proximal end of the inner frame 11 (12) (on the side toward the third position) and the inclined surface 11*ab* (12*ab*) formed on the side toward the upper end of the inner frame 11 (12) (on the side toward the second position), the dampening form roller 135 can be readily moved by rolling from the upper-end portions of the inner frames 11 and 12 (from the second position) to the proximal-end portions of the inner frames 11 and 12 (to the third position) and can be stably held on the proximal-end portions of the inner frames 11 and 12 (at the third position).

Since an end portion of the inner frame 11 (12) located on the side toward the proximal end (on the side toward the third position) includes the stopper portion 11*c* (12*c*), the dampening form roller 135 held on the horizontal surfaces 11*aa* and 12*aa* can be reliably prevented from dropping off the inner frames 11 and 12.

Also, even when, at the time of placing the dampening form roller 135 on the proximal-end portions of the inner frames 11 and 12, the axial position of the dampening form roller 135 deviates from an axial attachment position at which the dampening form roller 135 is attached to the frame 100 of the printing press, no problem arises. Specifically, since the supportive holder plate 37 can be slid in relation to the inner frames 11 and 12 along the axial direction of the dampening form roller 135 by means of the slide plates 31 and 32 and the like, the supportive holder plate 37 that carries the dampening form roller 135 can be slid as needed, whereby the axial position of the dampening form roller 135 can be readily corrected to a predetermined axial attachment position at which the dampening form roller 135 is attached to the frame 100 of the printing press. Thus, the dampening form roller 135 can be attached accurately and readily to the frame 100 at the predetermined axial attachment position via the levers 137, thereby enhancing work safety and facilitating work.

Since the supportive holder plate 37 is curved at a radius of curvature substantially equal to that of the dampening form roller 135, the supportive holder plate 37 can stably move the dampening form roller 135.

Since the dampening form roller 135 is supported by the supportive holder plate 37 and the supportive surfaces 11*d* and 12*d* of the inner frames 11 and 12, respectively, at a position (second position) located in the vicinity of a dampening-form-roller attachment position, the dampening form roller 135 can be readily transferred between the supportive holder plate 37 and the inner frames 11 and 12.

Since the roller moving apparatus according to the present embodiment can be removably provided within the frame 100 of the printing press, even in application to a multicolor printing press, there is no need to prepare a plurality of roller moving apparatus, so that the roller moving apparatus can be efficiently used.

Since the roller moving apparatus according to the present embodiment is configured such that the inner frames 11 and 12 rest on the roller 124*a* in the ink-roller group 124 of the inking unit 120 through abutment of the rest surfaces 11*b* and 12*b*, which are formed on the corresponding distal ends of the inner frames 11 and 12, on the outer circumferential surface of the roller 124*a*, the number of fixation jigs used to support the inner frames 11 and 12 can be reduced, thereby lessening labor and enhancing work efficiency.

In the present embodiment, the circumferential surface of the dampening form roller 135 is guided by the guide surfaces of the inner frames 11 and 12. However, the present invention is not limited thereto. For example, the end shafts 135*a* of the dampening form roller 135 may be supported by the corresponding guide surfaces of the inner frames 11 and 12.

The present embodiment is described while mentioning replacement of the dampening form roller 135 of the dampening unit 130 of the printing press. However, the present invention is not limited thereto. For example, the present invention may be applied to the following cases: replacement of an ink form roller of an inking unit of the printing press; replacement of another roller of a dampening unit or an inking unit of the printing press; and a case where a work for moving a detached roller from inside the frame to the exterior of the frame and a work for moving a roller to a predetermined position within the frame are very troublesome (for example, a case where the work forces an operator to assume an unnatural posture).

What is claimed is:

1. A roller moving apparatus, comprising:

a pair of inner frames removably supported in a frame;

a supportive holder member for supportively holding a roller; and supportive holder member moving means supported by the inner frames and adapted to support the supportive holder member and move the supportive holder member between a first position and a second position, the first position being either a position where the roller is attached to a support member, or a position in the vicinity of the roller supported by the support member, and the second position being a position where the roller is supported on the inner frames, wherein the inner frames have respective guide surfaces for guiding movement of the roller between the second position and a third position in the vicinity of an end surface of the frame.

2. A roller moving apparatus according to claim 1, wherein the supportive holder member is supported in such a manner as to be movable along an axial direction of the roller.

3. A roller moving apparatus according to claim 1, wherein the supportive holder member is curved at a radius of curvature substantially equal to that of an outer circumferential surface of the roller.

4. A roller moving apparatus according to claim 1, wherein the supportive holder member and supportive surfaces of the inner frames support the roller at the second position.

5. A roller moving apparatus according to claim 1, wherein the guide surfaces of the inner frames includes respective horizontal surfaces formed on a side toward the third position, and respective inclined surfaces formed on a side toward the second position.

6. A roller moving apparatus according to claim 5, wherein end portions of the inner frames located on the side toward the third position include respective stopper portions located higher than the horizontal surfaces.

7. A roller moving apparatus according to claim 1, wherein a distance between the paired inner frames disposed in such a manner as to face each other along an axial direction of the roller is shorter than a length of the roller in the axial direction.

8. A roller moving apparatus according to claim 1, wherein the guide surfaces of the inner frames guide a circumferential surface of the roller.

9. A roller moving apparatus according to claim 1, wherein the supportive holder member moving means includes:

a threaded shaft supported rotatably by the inner frames;

threaded shaft rotating means for rotating the threaded shaft;

a nut block screw-engaged with the threaded shaft;

a movable member supported integrally by the nut block; and a slide plate adapted to support the supportive holder member and supported by the movable member in such a manner as to be slidable along an axial direction of the roller.

10. A roller moving apparatus according to claim 9, wherein the threaded shaft rotating means is located in the vicinity of the end surface of the frame.

11. A roller moving apparatus according to claim 9, wherein the threaded shaft is provided on each of the inner frames disposed in such a manner as to face each other along an axial direction of the roller, and the threaded shaft rotating means includes:

a pair of threaded shaft side bevel gears provided on corresponding proximal ends of the threaded shafts;

a pair of intermediate bevel gears meshed with the corresponding threaded shaft side bevel gears;

a driven shaft supported rotatably between the paired inner frames and adapted to coaxially support the paired intermediate bevel gears;

a drive bevel gear meshed with one of the intermediate bevel gears; and a drive shaft connected coaxially to the drive bevel gear.

12. A roller moving apparatus according to claim 11, wherein the threaded shafts and the drive shaft of the threaded shaft rotating means are arranged such that an axial direction of the threaded shafts and an axial direction of the drive shaft intersect each other.

13. A roller moving apparatus according to claim 1, wherein the roller is a roller of a dampening unit or an inking unit of a printing press, and the inner frames are removably supported by an ink fountain of the inking unit.

14. A roller moving apparatus according to claim 13, wherein the inner frames have respective rest surfaces formed at distal ends and rest on a roller other than the roller disposed within the printing press, through abutment of the rest surfaces on an outer circumferential surface of the roller.

* * * * *